US010662595B2

(12) United States Patent
Buschmann et al.

(10) Patent No.: US 10,662,595 B2
(45) Date of Patent: May 26, 2020

(54) ROAD FINISHING MACHINE WITH COMPACTING MESSAGE DISPLAY UNIT

(71) Applicant: JOSEPH VOEGELE AG, Ludwigshafen/Rhein (DE)

(72) Inventors: Martin Buschmann, Neustadt (DE); Achim Eul, Mannheim (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 0 days.

(21) Appl. No.: 15/215,787

(22) Filed: Jul. 21, 2016

(65) Prior Publication Data

US 2017/0030036 A1 Feb. 2, 2017

(30) Foreign Application Priority Data

Jul. 28, 2015 (EP) ..... 15178636

(51) Int. Cl.
*E01C 23/07* (2006.01)
*E01F 9/518* (2016.01)
(Continued)

(52) U.S. Cl.
CPC ..... *E01F 9/518* (2016.02); *E01C 7/00* (2013.01); *E01C 9/001* (2013.01); *E01C 19/08* (2013.01); *E01C 19/43* (2013.01); *E01C 19/48* (2013.01)

(58) Field of Classification Search
CPC ..... E01C 19/002
(Continued)

(56) References Cited

U.S. PATENT DOCUMENTS 5,921,708 A * 7/1999 Grundl ..... E01C 19/48 180/168
6,749,364 B1 * 6/2004 Baker ..... E01C 19/288 404/118
(Continued)

FOREIGN PATENT DOCUMENTS

CN 101446059 A 6/2009
CN 104099657 A 10/2014
(Continued)

OTHER PUBLICATIONS

Extended European Search Report dated Mar. 7, 2016, Application No. 15178636.5-1604, Applicant Joseph Vögele AG, 12 pages.
(Continued)

*Primary Examiner* — Thomas B Will
*Assistant Examiner* — Katherine J Chu
(74) *Attorney, Agent, or Firm* — Brooks Kushman P.C.

(57) ABSTRACT

A road finishing machine comprising a paving screed for the production of a new road pavement layer of a paving material and a unit provided on the road finishing machine to generate a dynamic compacting specification field based on thermographic geosignals with regard to at least one temperature image that exists behind the paving screed of the road finishing machine for at least one surface section of the newly installed road pavement layer. An information indication unit provided on the road finishing machine is configured to display at last one compacting message that is at least partially based on the compacting specification field to an operator of at least one compacting vehicle that follows behind the road finishing machine for compacting of the newly installed road pavement layer.

9 Claims, 3 Drawing Sheets

(51) Int. Cl.

| | |
|---|---|
| ***E01C 19/48*** | (2006.01) |
| ***E01C 7/00*** | (2006.01) |
| ***E01C 9/00*** | (2006.01) |
| ***E01C 19/08*** | (2006.01) |
| ***E01C 19/43*** | (2006.01) |

(58) Field of Classification Search
USPC ..... 404/75, 84.05, 84.1, 118
See application file for complete search history.

(56) References Cited

U.S. PATENT DOCUMENTS

| | | | | |
|---|---|---|---|---|
| 7,172,363 | B2 * | 2/2007 | Olson | E01C 19/006 404/118 |
| 7,578,634 | B2 * | 8/2009 | Velsor | E01C 23/14 404/95 |
| 8,077,023 | B2 * | 12/2011 | King | B60Q 1/2657 340/426.15 |
| 8,099,218 | B2 | 1/2012 | Glee et al. | |
| 8,337,118 | B2 * | 12/2012 | Buschmann | E01C 19/48 404/84.5 |
| 8,382,395 | B2 * | 2/2013 | Glee | E01C 19/004 404/78 |
| 8,562,246 | B2 * | 10/2013 | Utterodt | E01C 19/48 404/79 |
| 8,931,974 | B2 | 1/2015 | Herzberg | |
| 8,979,424 | B2 * | 3/2015 | Berning | E01C 23/088 116/202 |
| 9,068,295 | B2 | 6/2015 | Rutz et al. | |
| 9,394,653 | B2 | 7/2016 | Rutz et al. | |
| 9,447,549 | B2 | 9/2016 | Buschmann et al. | |
| 9,476,168 | B2 * | 10/2016 | Oetken | E01C 19/002 |
| 9,759,708 | B2 * | 9/2017 | Marsolek | G01N 33/42 |
| 9,783,112 | B2 * | 10/2017 | Payne | B60R 1/00 |
| 10,001,783 | B2 * | 6/2018 | Zahr | E01C 19/48 |
| 2008/0259730 | A1 * | 10/2008 | Di Federico | E01C 19/006 367/118 |
| 2009/0142133 | A1 | 6/2009 | Glee et al. | |
| 2010/0021233 | A1 * | 1/2010 | Chandler | E01C 23/14 404/77 |
| 2010/0189498 | A1 * | 7/2010 | Doherty | G08G 1/096811 404/72 |
| 2014/0308073 | A1 * | 10/2014 | Delius | E01C 19/288 404/72 |
| 2014/0308074 | A1 | 10/2014 | Rutz et al. | |
| 2016/0134995 | A1 * | 5/2016 | McCoy | H04L 67/104 455/41.2 |
| 2017/0030036 | A1 | 2/2017 | Buschmann et al. | |

FOREIGN PATENT DOCUMENTS

| | | | |
|---|---|---|---|
| CN | 206173774 | U | 5/2017 |
| DE | 102008058481 | A1 | 7/2009 |
| EP | 2666908 | A1 | 11/2013 |
| EP | 2789741 | A1 | 10/2014 |
| JP | 4-122709 | U | 11/1992 |
| JP | 6-48100 | U | 6/1994 |
| JP | 2000-290943 | A | 10/2000 |
| JP | 2005-97958 | A | 4/2005 |
| JP | 2012-225153 | A | 11/2012 |
| JP | 2013-217187 | A | 10/2013 |
| JP | 2014-206043 | A | 10/2014 |
| JP | 2014-206044 | A | 10/2014 |
| WO | 0070150 | A1 | 11/2000 |

OTHER PUBLICATIONS

Japanese Office Action and Search Report dated Jun. 30, 2017, Application No. 2016-147536, Office Action (5 Pages); Search Report (18 Pages).

Chinese Search Report dated Apr. 18, 2018, Application No. 2018105976620, 1 Page.

Chinese Office Action dated May 2, 2018, Application No. 201810597662.0, Application Joseph Fu Gele Company, 7 Pages.

* cited by examiner

ROAD FINISHING MACHINE WITH COMPACTING MESSAGE DISPLAY UNIT

CROSS-REFERENCE TO RELATED APPLICATIONS

This application claims foreign priority benefits under 35 U.S.C. § 119(a)-(d) to European patent application number EP 15 178 636.5, filed Jul. 28, 2015, which is incorporated by reference in its entirety.

TECHNICAL FIELD

The present disclosure relates to a road finishing machine. Further, the present disclosure relates to a method for installing a road pavement layer by means of a road finishing machine.

BACKGROUND

During installation of new road pavement layers, the processing temperature of asphalt is an essential process parameter and has a significant influence on the properties of use of the pavement layer, e.g., on the bond between layers as well as the lifespan of the newly installed road pavement. For this reason, measurement of the installation temperature becomes increasingly important.

In practice, at least one compacting vehicle follows the road finishing machine during the installation of road pavement in order to compact the road pavement installed by means of the paving screed of the road finishing machine. The asphalt temperature of the newly installed road pavement is an important process parameter for the first entry of the compacting vehicle into the freshly installed road pavement. Therefore, finding the right time for compacting, i.e., for entry of the compacting vehicle into the new road pavement, is essential.

On one hand, too early entry into too hot asphalt leads to structural faults such as compacting cracks; on the other hand, too late entry leads to the asphalt being already cooled down strongly so that there is less time for roller compacting. Ideally, exactly the right time and/or the right temperature for the start of roller compacting should be determined.

The EP 2 789 741 A1 discloses a road finishing machine with a thermographic module that is configured to determine at least temperature ranges of the newly installed pavement layer behind the paving screed. On this basis, in particular functions on the road finishing machine are regulated during installation of the pavement.

Furthermore, special compacting vehicles with a pyrometer device are used nowadays to measure the surface temperature of the asphalt. In this process, the compacting vehicle driver on the compacting vehicle is told by means of a temperature display device how hot the asphalt is under his compacting vehicle. The compacting vehicle driver uses this temperature information for the compacting process as a routine action. In this application, however, the compacting vehicle driver only recognizes a too early entry into the hot asphalt when it is already too late, i.e., after having entered too hot asphalt material.

An asphalting system in which a road finishing machine is data-linked to multiple compacting vehicles following such road finishing machine is disclosed in the DE 10 2008 058 481 A1. Based on a temperature data model that is in particular created by the road finishing machine, the following compacting vehicles can receive navigation signals in order to move over the newly created road pavement at predefined distances to each other as well as in particular to the preceding road finishing machine. To achieve this data networking of the vehicles integrated in the asphalting system, such vehicles are equipped respectively with senders and receivers in order to share temperature and/or position data among each other. However, this requires all vehicles that are integrated in the asphalting system to be equipped with costly sender-receiver units in order to enable the data exchange among each other.

In reality, however, paving trains are flexibly composed of finishing and compacting vehicles at the construction site, especially for reasons of cost, whereby machines from different manufacturers, in part rental machines, are used for the paving train. Therefore, a data link according the asphalting system of the DE 10 2008 058 481 A1 is difficult to implement in such a paving train.

SUMMARY

The purpose of the present disclosure is to provide a road finishing machine that enables an improved compacting process with simple, constructive technical means. The purpose of the disclosure also consists of providing a method that is suitable for this task.

The disclosure relates to a construction machine that is formed as a self-propelled road finishing machine. The road finishing machine comprises a paving screed to produce a new road pavement layer of a paving material. In addition, the road finishing machine comprises a device to be installed on the road finishing machine to generate a dynamic compacting specification field based on thermographic geosignals with regard to at least one temperature image for at least one surface section of the newly installed road pavement that exists behind the paving screed of the road finishing machine.

The compacting specification field is a surface-related temperature data model that assigns a temperature distribution recorded on an area of the newly installed road pavement behind the paving screed to such area. The respective points on the surface can for example be determined in relation to a reference coordinate system of the road finishing machine, whereby the area allocation to the temperature image occurs for example based on an XYZ-coordinate relationship in relation to the road finishing machine, in particular to the reference coordinate system. The X-coordinate could thereby define for example the normal distance to the reference coordinate system of the road finishing machine seen in the direction of travel, and the Y-coordinate a lateral distance, from a transversal perspective to the direction of travel, to the reference coordinate system of the road finishing machine. The Z-coordinate could stand for a difference in height/depth to the reference coordinate system.

According to the disclosure, an information indication unit is provided on the road finishing machine to signal a compacting message for an operator of at least one compacting vehicle that follows the road finishing machine. The compacting message is based at least partially on the recorded compacting specification field.

According to the disclosure, the entire information indication unit may be fixed directly on the road finishing machine. Hence, all navigation messages for the following compacting vehicle(s) are sent out by the road finishing machine. An additional, associated equipment on the compaction vehicles is not required so that any compaction vehicles in the paving train can be used together with the road finishing machine according to the disclosure. This facilitates the composition of the paving train at the construction site, whereby such paving train can be composed in particular of rental compacting vehicles from different manufacturers without there being any risks with regard to the compaction quality.

In the disclosure, the equipment of the road finishing machine itself and not the special equipment of the compacting vehicles therefore plays the vital role for an optimal compaction of the new road pavement.

In the disclosure, the compacting message sent out by the information indication unit is intended for an operator of at least one compacting vehicle. The information indication unit of the disclosure is therefore not comparable with a display unit of the road finishing machine to display signals to the operator of the road finishing machine. Rather, the information indication unit of the disclosure offers exclusively an auxiliary device for the operator on the compacting vehicle who mostly follows the road finishing machine at a distance of several meters.

In contrast to the state of the art, the compacting messages generated by the information indication unit are visible for the operator of the compacting vehicle following the road finishing machine, without additional display units on the compacting vehicle being required for this purpose. Consequently, the compacting messages become apparent for the operator of the compacting vehicle exclusively via the information indication unit of the road finishing machine without creating a data exchange between the road finishing machine and the compacting vehicle for this purpose.

A value specification is preferably stored in the device for the generation of the compacting specification field, comprising a maximum and/or a minimum compacting temperature, whereby the device is configured to determine a minimum distance and/or a maximum distance out of a comparison of the value specification with the thermographic geosignals for the compacting specification field that the compacting vehicle behind the road finishing machine should maintain. The device to generate the compacting specification field is therefore formed to compare actual values in form of area-related temperature values of the surface section behind the paving screed with at least one nominal value given by the maximum and/or the minimum compacting temperature in order to determine on this basis the compacting specification field, in particular a minimum distance and/or maximum distance set by these values. Seen in relation to the road finishing machine, the compacting specification field can thereby be mapped for example as a compacting window between the road finishing machine and the compacting vehicle that follows such road finishing machine. The minimum distance and/or the maximum distance, however, could also be displayed to the operator of the compacting vehicle in a different way.

Because the recorded temperature values may be non-uniform on the surface section behind the paving screed, in particular when contemplated in the direction of travel, the respective minimum and/or maximum distances of the compacting specification field can change dynamically on this basis. Hence, there could be a dynamic adaptation of the compacting specification field and hence also of the dynamic compacting message of the information indication unit based on it especially during asphalting of junctions of a bridge section.

For the operator of the compacting vehicle driving behind the road finishing machine, it is particularly helpful if the derived minimum distance and/or the maximum distance can be displayed on the information indication unit as numerical data in meters and/or feet. Based on these distance indications, the operator of the compacting vehicle can easily estimate the distance at which he should follow the road finishing machine driving ahead so that he will drive over the newly installed road pavement layer installed by him with his compacting vehicle at an optimal time. For this purpose, the information indication unit could be formed as a screen that is equipped with a plurality of LED lamps to display the compacting message in meters and/or feet. It would also be conceivable that a color of the LED lamps is adjustable manually and/or automatically in view of the weather conditions and/or the time of the day.

The meter and/or foot indication for a minimum and/or maximum distance is measured preferably from a rear edge of the paving screed to the compacting vehicle that follows. As the operator of the compacting vehicle normally has a good view onto the paving screed that is fixed on road finishing machine driving ahead, he can make a good estimate of the distance specification measured from there so that he can maintain exactly the minimum and/or maximum distance to the paving screed, i.e., that he can steer his compacting vehicle over an area between the minimum and the maximum distance. Thanks to this, an optimal compacting result is achieved.

According to an embodiment of the disclosure, the information indication unit is a projection unit that is formed to project the compacting message at least in sections onto the new road pavement behind the paving screed, i.e., onto a surface section between the road finishing machine and the compacting vehicle that follows the road finishing machine. Due to this, the operator of the compacting vehicle can read the compacting message in front of him directly on the new road pavement. The newly installed road pavement layer forms an excellent projection surface for the compacting message. The compacting message is well visible for the operator of the compacting vehicle on this projection surface. Even rising vapors above the paving screed during the installation work of the road finishing machine do not disturb the projection of the compacting messages.

In this process, it is particularly helpful if the projection unit comprises at least one laser that is formed to project at least a line that is aligned transversally to the direction of travel, a command, for example a meter or foot indication and/or a map of the compacting specification field as a compacting message onto the newly installed road pavement layer. This line created by means of the laser is particularly well visible for the operator of the compacting vehicle. The projection unit is preferably configured to vary the color of the laser light according to the daylight conditions so that all compacting messages are always well recognizable during day and night works. Adaptation of the laser light to the daylight conditions can occur automatically. Alternatively or in addition, an operator of the road finishing machine could set the laser light color of the projection unit manually. This can preferably take place on the control module of the road finishing machine.

According to a further embodiment of the disclosure, the information indication unit comprises an uncoiling unit with at least one coiling element whereby the uncoiling unit is formed to drag the coiling element as a boom with a varying length behind or next to the paving screed in representation of the generated compacting specification field. The coiling element could for example be formed as a tape that is weighed down at certain points where required in order to be dragged evenly on the newly produced road pavement behind the paving screed. The uncoiling length of the coiling element can thereby be determined by an electric engine of the uncoiling unit, which is functionally connected to the unit to generate the compacting specification field and configured in a way as to set an appropriate length for the coiling element behind the paving screed according to a coiling signal of the unit for generating the compacting specification field. An end of the coiling element could for example display to the operator of the compacting vehicle a minimum distance that he should maintain to the paving screed.

It would also be conceivable that two coiling elements are dragged behind the paving screed to determine with one coiling element the minimum distance and with the other one the maximum distance with regard to the compacting specification field, whereby the distances can be displayed to the operator of the compacting vehicle through the respective ends of the two coiling elements. Hence, the compacting window can be spread out in an imaginary way between the respective ends of the coiling elements dragged behind the paving screed on the surface of the new road pavement, whereby the operator of the compacting vehicle can align his compacting vehicle in relation to the road finishing machine. The respective coiling elements are preferably arranged next to each other at a maximum distance of one meter on the side of the paving screed of the road finishing machine so that the compacting vehicle(s) following such road finishing machine will not drive onto the coiling elements.

The road finishing machine preferably comprises a measurement unit that is formed to record a distance to the following compacting vehicle and to take into account a comparison of the recorded distance with the compacting specification field during generation of the compacting message. The measurement unit can be used functionally with all described information indication units. Thereby, the emission of the compacting message can be based at least partially on a measurement of the distance to the following compacting vehicle.

The measurement unit can be formed as part of the device to generate the dynamic compacting specification field. Alternatively, the measurement device can form a separate unit on the road finishing machine that is fixed preferably on a roof structure or on the paving screed of the road finishing machine. To record the distance to the following compacting vehicle, the measurement unit comprises preferably at least one distance sensor, preferably an infrared, an ultrasound and/or a laser sensor.

The device to generate the compacting specification field is preferably configured to compare the distance to the following compacting vehicle that is actually measured with the nominal value of the minimum and/or maximum distance and to generate on the basis of this comparison the compacting message discussed before or an additional compacting message for the operator of the following compacting vehicle, for example that he should accelerate his compacting vehicle. Hence, it quickly becomes clear to the operator whether he needs to reduce or increase the distance to the road finishing machine driving ahead so that he will drive over the newly installed road pavement at an optimal point in time.

The information indication unit comprises preferably a signal lamp that is configured to emit at least one visual signal as a compacting message. For the operator of the compacting vehicle, the signal lamp can be realized as an information indication device in a particularly easy way. In particular, it can be displayed in color on the signal lamp whether the compacting vehicle is driving behind the road finishing machine at a correct distance. For example, the display of a red light by the signal lamp could mean that the compacting vehicle has driven too far away from the road finishing machine and/or too close to the paving screed of the road finishing machine. In contrast, the display of a green signal light by the signal lamp could mean that the distance that exists between the road finishing machine and the following compacting vehicle is optimal for the achievement of an optimal degree of compaction of the newly installed road pavement. The function of the signal lamp is in particular based on a comparison of the measured distance to the following compacting vehicle by means of the measurement unit with the determined minimum and/or maximum distance by the device for generating the compacting specification field.

The information indication unit is particularly well visible for the operator of the following compacting vehicle when it is fixed on a roof structure, in particular on a vertical roof beam at the rear of the road finishing machine. It would also be conceivable to have respectively one information indication unit for the compacting process fixed on both vertical roof beams at the rear of the road finishing machine.

The surface of the newly installed road pavement can have different temperature zones. Therefore, it is advantageous if the device to generate the compacting specification field is configured in a way as to allocate different compacting specification fields to the respective temperature zones. Different temperature zones could for example be formed over the installation width of an extendable screed, which is followed by multiple compacting vehicles. Through the respective temperature zones, it could be displayed to the respective compacting vehicles at what distances they should drive behind the road finishing machine to the paving screed section dragged ahead. Thereby, it can be possible that the respective compacting vehicles compact at different distances to the road finishing machine driving ahead due to the varying temperature zones that exist over the installation width.

According to a variant of the disclosure, the road finishing machine comprises a thermography module to generate the thermographic geosignals in relation to the temperature image that exists behind the paving screed of the road finishing machine. The thermography module is disposed preferably on the roof structure above the paving screed so that it can capture an area behind the paving screed well with regard to the temperature values existing in it.

The thermography module is preferably fixed detachably on the roof structure of the road finishing machine so that it can be removed from the road finishing machine during downtimes of the latter, in particular during the night. Therefore, theft of the thermography module is prevented, especially in cases where the road finishing machine remains at the construction site overnight.

Further preferably, the unit to generate the dynamic compacting specification field is disposed within a housing of the thermography module, in other words formed as an integral part with the thermography device. The housing of the thermography module offers excellent protection for the device for generating the dynamic compacting specification field. Alternatively, the device for generating the dynamic compacting specification field can be disposed as a separate unit on the road finishing machine, in particular in its control module.

Activation of the device for generating the dynamic compacting specification field can occur automatically and/or manually by an operator of the road finishing machine. An operation of the device for generating the dynamic compacting specification field can in particular take place in an automated way if the operator of the road finishing machine triggers a compacting message mode for example on the operating stand of the road finishing machine or on a screed operating stand. Hence, the operator can himself determine the time at which he wishes to generate compacting messages by means of the information indication unit that is functionally connected to the unit for generating the compacting specification field.

The device for generating the dynamic compacting specification field is preferably also formed to take into account a cooling rate for the surface of the newly installed road pavement surface during generation of the compacting specification field. Thus, at least one point within the compacting specification field could be assigned a favorable compacting time at which the point has an optimal compacting temperature. This can for example be calculated by means of an algorithm or several algorithms based on a temperature image of the surface section behind the paving screed and, where appropriate, in addition based on an external temperature.

The disclosure also relates to a method for the installation of a road pavement layer by a road finishing machine, whereby at least one compacting message is displayed to an operator of at least one compacting vehicle that follows behind the road finishing machine for compacting of the road pavement layer installed by the road finishing machine by means of an information indication unit provided on the road finishing machine that is driving ahead. The compacting messages can thereby be displayed visibly to the operator of the following compacting vehicle from the road finishing machine so that this operator can control his compacting process in relation to the compacting messages generated on and/or by the road finishing machine that drives ahead.

The compacting message is displayed preferably based on a compacting specification field that is generated using thermographic geosignals with regard to at least one temperature image that exists behind a paving screed of the road finishing machine for at least one surface section of the installed road pavement layer. The compacting specification field thereby exists as a temperature place data model based on which the information indication unit provided on the road finishing machine according to the disclosure generates compacting signals that the operator of the following compacting vehicle can see without additional display devices provided on his compacting vehicle.

For the generation and display of the compacting messages, all devices of the road finishing machine described before can be used.

In the following, preferred embodiments of the disclosure will be explained in greater detail making reference to the attached drawings.

Identical components are consistently marked with identical reference signs in the Figures.

DETAILED DESCRIPTION

As required, detailed embodiments are disclosed herein; however, it is to be understood that the disclosed embodiments are merely exemplary and that various and alternative forms may be employed. The figures are not necessarily to scale; some features may be exaggerated or minimized to show details of particular components. Therefore, specific structural and functional details disclosed herein are not to be interpreted as limiting, but merely as a representative basis for teaching one skilled in the art.

Figure 1:
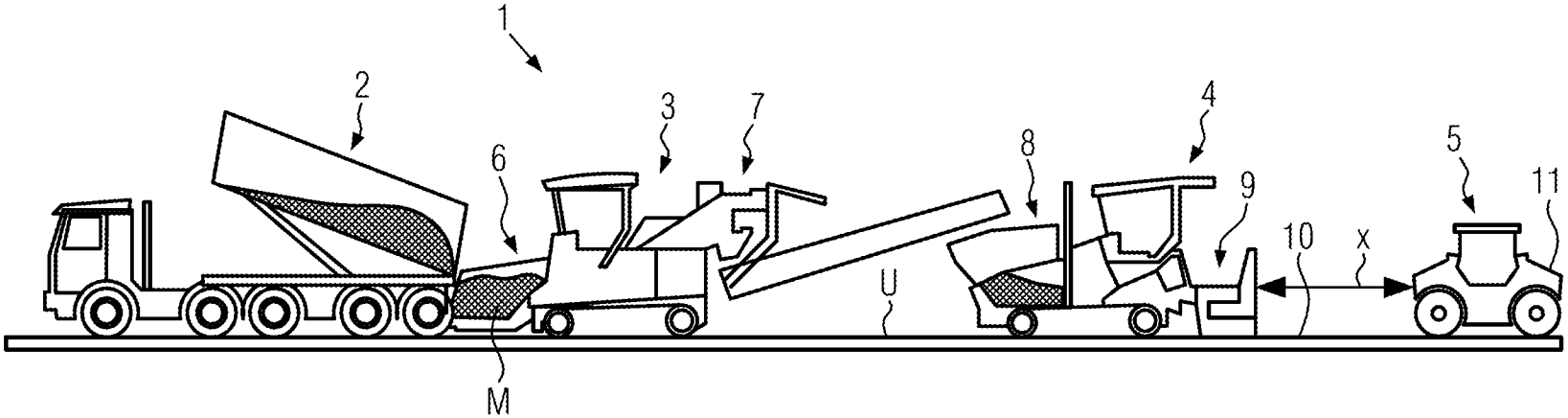
FIG. 1 is a lateral view of a paving train for the installation of a new road pavement layer.

FIG. 1 shows a paving train 1. A material supply vehicle 2, a feeder 3, a road finishing machine 4 as well as a compacting vehicle 5 that drives behind the road finishing machine 4 are disposed in a row in the paving train 1.

The material supply vehicle 2 fills paving material M into a receiving tray 6 of the feeder 3. The paving material M is conveyed via a conveyor device 7 of the feeders 3 into a material hopper 8 of the road finishing machine 4.

The road finishing machine 4 comprises a paving screed 9 that is fixed relocatably on the road finishing machine 4. The paving material M is transported from the material hopper 8 of the road finishing machine 4 to the paving screed 9. The paving screed 9 is configured to install the paving material M into a new road pavement layer 10. Depending on the temperature distribution in the paving material M as well as depending on the temperature of the subsoil, the road pavement layer 10 has a location-specific temperature behind the paving screed 9.

The compacting vehicle 5 that follows the road finishing machine 4 is a roller vehicle 11. The roller vehicle 11 drives over the newly installed road pavement layer 10 in order to compact such layer. According to FIG. 1, the roller vehicle 11 drives behind the paving screed 9 of the road finishing machine 4 at a distance X. In this process, the roller vehicle 11 should not drive too closely behind the paving screed 9 of the road finishing machine 4 because it would as a result enter the newly installed and still too hot road pavement 10 too early, which would potentially lead to material cracks in the road pavement layer 10. On the other hand, the roller vehicle 11 should not follow the paving screed 9 of the road finishing machine 4 at a distance X that is too large because in that case the road pavement layer 10 would cool down too much before being compacted by the roller vehicle 11. Due to this, the roller vehicle 11 would no longer achieve the desired degree of compaction for the road pavement layer 10.

In view of this, the distance X between the paving screed 9 and the compacting vehicle 5 has to be chosen in a way as to be able to avoid the aforementioned problems.

The road finishing machine 4 according to the disclosure helps the operator of the following compacting vehicle 5 maintain the distance X to the paving screed of the road finishing machine in a way that an excellent compaction of the new road pavement layer 10 takes place without installation cracks and with a desired degree of compaction.

Figure 2:
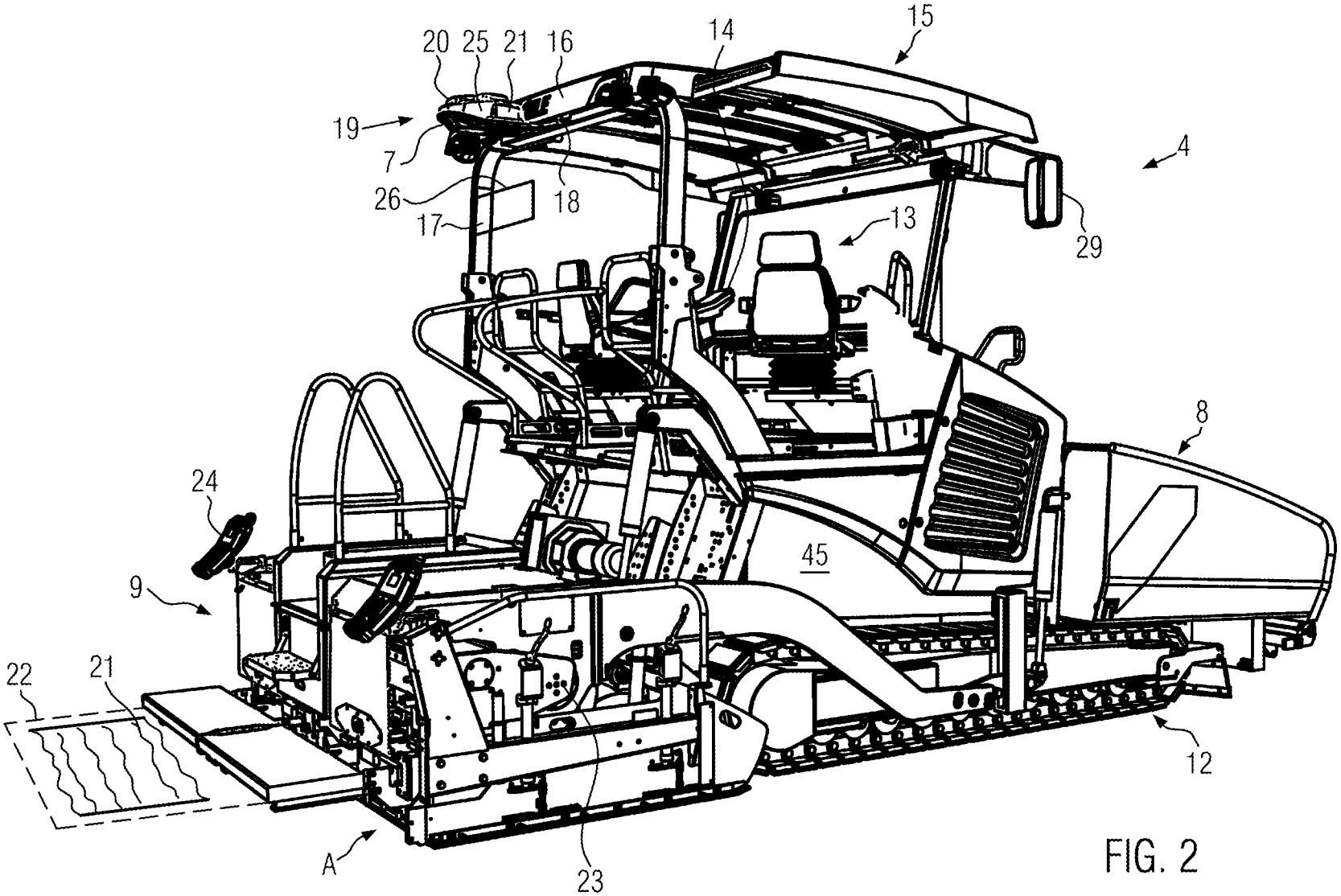
FIG. 2 is a road finishing machine according to the disclosure with a display unit to display at least one compacting message for the operator of a compacting vehicle that follows the road finishing machine.

The road finishing machine 4 according to the disclosure is illustrated in an enlarged perspective view in FIG. 2.

In FIG. 2, the road finishing machine 4 has a crawler chassis 12. Instead of the crawler chassis 12, however, the road finishing machine 3 according to the disclosure could also comprise a wheel chassis. The road finishing machine 4 further comprises an operating stand 13 with an operating panel 14 that is formed as a control module by means of which the operator of the road finishing machine 4 can control a plurality of operating functions of the road finishing machine 4.

The road finishing machine 4 further comprises a roof structure 15 with a roof 16 that is supported by vertical roof beams 17. A thermography module 19 is fixed on a crossbeam 18 that connects the rear vertical roof beams 17. The thermography module 19 has a housing 20 within which a plurality of electronic components is disposed in a protected way. In particular, there is an infrared camera 21 inside the housing 20. By means of the infrared camera 21, a schematically displayed temperature image 21 of a surface section 22 shown behind the paving screed 9 can be recorded. The infrared camera 21 is designed to record surface sections 22 of different sizes behind the paving screed 9 and/or a differently large temperature image 21 of the surface section 22 depending on the type of paving screed 9 used.

The paving screed 9 shown in FIG. 2 is an extendable screed A with lateral extending units 23. The latter can be extended laterally for the installation of a large width for the road pavement layer 10. FIG. 2 further shows that respectively one screed operating module 24 is fixed on the respective extending units 23 of the paving screed 9. Operating functions of the paving screed 9 can be controlled by means of the screed operating module 24. In particular, the paving screed 9 can be leveled by means of the screed operating modules 24 in order to produce an even road pavement layer 10.

FIG. 2 further shows in a schematic view that a unit 25 for generating a dynamic compacting specification field is disposed in the housing 20 of the thermography module 19. The unit 25 for generating a dynamic compacting specification field is configured to produce the compacting specification field based on thermographic geosignals that are created by the thermography module 19.

FIG. 2 further shows in a schematic view that an information indication unit 26 is fixed on the vertical roof beam 17. However, the information indication unit 26 can also be fixed at another point of the roof structure or on the paving screed 9 of the road finishing machine 4. The information indication unit 26 can as well be fixed within the housing 20 of the thermography unit 19. This is explained in greater detail in connection with FIGS. 3 to 5. By means of the information indication unit 26, compacting messages can be displayed to the operator of the compacting vehicle 5 shown in FIG. 1.

Figure 3:
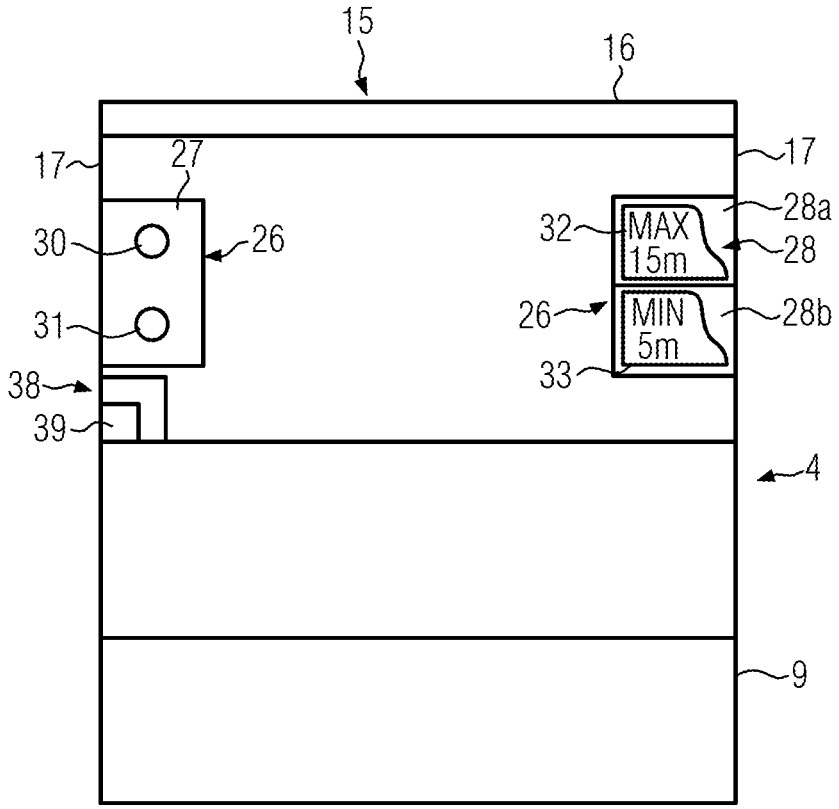
FIG. 3 is a schematic display of a road finishing machine according to the disclosure from the rear with a display unit according to the embodiment.

A schematic rear view of the road finishing machine 4 according to the disclosure is displayed in FIG. 3. In FIG. 3, the information indication unit 26 on the left roof beam 17 is formed as a signal lamp 27. On the roof beam 17 on the right, the information indication unit 26 comprises a meter and/or foot display 28 to display the compacting specification as numerical data.

In FIG. 3, the road finishing machine 4 comprises both the signal lamp 27 as well as the meter and/or foot display unit 28 whereby it would be possible to equip the road finishing machine 4 only with one of these information indication units 26.

According to FIG. 3, the information indication units 26 are inward-facing from the roof beam 17 so that the operator of the road finishing machine 4 does not have a obstructed view when looking into the rear-view mirror 29 (see FIG. 2) of the road finishing machine 4. It would also be conceivable to fix at least one of the information indication units 26 on the crossbeam 18 of the roof structure 15.

The signal lamp 27 comprises a first signal lamp 30 and a second signal lamp 31. The first signal lamp 30 can be configured to emit a red signal light when the compacting vehicle 5 following behind the road finishing machine 4 maintains a too short or a too long distance X behind the paving screed 9. This would tell the operator of the compaction vehicle 5 that he has to change his distance X to the paving screed 9 towed ahead in order to achieve an optimal compacting result in the road pavement layer 10.

Where appropriate, the first signal lamp 30 could be configured to emit a persistent red light when the compacting vehicle 5 has come too close to the paving screed 9, i.e., when the distance X is too short. The operator of the compacting vehicle 5 would then realize immediately that he needs to slow down the compacting vehicle 5 in order to move further away from the paving screed 9 of the road finishing machine. The first signal lamp 30 could otherwise be configured to emit an intermittently flashing red light to tell the following compacting vehicle that it drives too far away behind the paving screed 9. The operator of the compacting vehicle 5 would then have to accelerate the compacting vehicle 5 so that the distance X to the road finishing machine 4 driving ahead becomes shorter.

The second signal lamp 31 can be configured to emit a green signal light when the compacting vehicle 5 drives behind the paving screed 9 of the road finishing machine 4 at a desired distance X. Then, the compacting vehicle X is at such a distance from the road finishing machine 4 that it can achieve an optimal compacting result.

The meter and/or foot display unit 28 shown in FIG. 3 is divided into a first display field 28A to display a maximum distance 32 and a second display field 28B to display a minimum distance 33. The first display field 28A shows the operator of the following compacting vehicle 5 by means of the maximum distance 32 at what maximum distance he should drive behind the paving screed 9 of the road finishing machine 4. Should the operator drive his compacting vehicle 5 behind the paving screed at a distance that exceeds the maximum distance 32, the road pavement layer 10 would cool down too strongly because the compacting vehicle 5 would compact the asphalt of the road pavement layer 10 too late. In this process, a desired degree of compaction would not be achieved anymore.

In the second display field 28B, the operator of the compacting vehicle 5 is shown based on the minimum distance 33 how closely he may drive behind the paving screed 9 of the road finishing machine 4. If the operator undercut the minimum distance 33, he would drive the compacting vehicle 5 too closely behind the paving screed 9, i.e., enter the still too hot road pavement layer 10 too early, which could lead to material cracks in the road pavement.

Depending on the installation material M used as well as depending on the temperature of the subsoil U, the information displayed by the information indication units 26 from FIG. 3 can vary. The information indication units 26 therefore emit dynamic compacting messages to the operator of the following compacting vehicle 5.

It is also conceivable that both of the information indication units 26 shown in FIG. 3, i.e., the signal lamp 27 as well as the meter and/or foot display unit 28, are functionally connected to each other. In particular, the signal lamp 27 can be operated with regard to the determined minimum and/or maximum distance as well as with regard to the measured distance X.

Furthermore, it would be possible for the meter and/or foot display unit 28 to display a numerical value with a plus sign and/or with a minus sign, whereby the operator of the compacting vehicle 5 is prompted by a numerical display with the plus sign to increase the distance X to the road finishing machine 4 driving ahead and/or that he is prompted by a numerical display with a minus sign to reduce the distance X to the road finishing machine 4 that is driving ahead.

FIG. 3 further shows a measurement unit 38 that is configured to measure the distance X to the following compacting vehicle, preferably by means of an infrared sensor 39. Based on the distance X to the following compacting vehicle 5 measured by means of the measurement unit 38 as well as based on the maximum and/or minimum distance 32, 33, one of the display units 26 from FIG. 3 and/or another display unit 26 according to the embodiment can tell the roller driver whether he has to reduce or increase the distance X to the road finishing machine 4 that is driving ahead.

Figure 4:
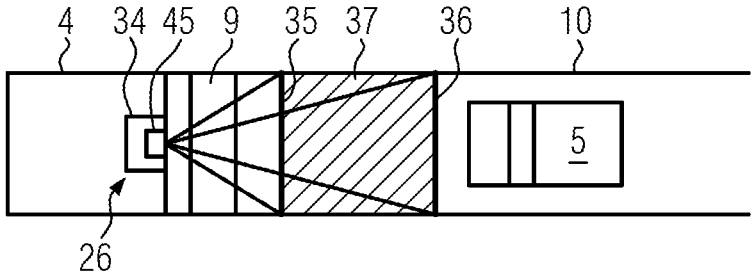
FIG. 4 is a schematic top view of a road finishing machine according to the disclosure as well as a compacting vehicle following such road finishing machine.

FIG. 4 shows another embodiment variant of the road finishing machine 4 to display a compacting message to the following compacting vehicle 5. In FIG. 4, the information indication unit 26 is formed as a projection unit 34. The projection unit 34 comprises a laser 45 that is configured to project a first laser line 35 based on the compacting specification field of the unit 25 for generating a compacting specification field as well as a second laser line 36 onto the road pavement layer 10 between the road finishing machine 4 and the following compacting vehicle 5. The first laser line 35 indicates the minimum distance 33 that the compacting vehicle 5 should maintain behind the paving screed 9. Similarly, the second laser line 36 indicates the maximum distance 32 that the compacting vehicle 5 should maintain from the paving screed 9 of the road finishing machine 4 as a maximum.

In FIG. 4, the compacting vehicle 5 would have to join up to the road finishing machine 4 to compact the road pavement layer 10 between the first and the second laser line 35, 36. As explained before in connection with the information indication units 26 from FIG. 3, also the first as well as the second laser line 35, 36 can vary with regard to the cooling rate of the newly installed road pavement layer 10.

Based on the laser lines 35, 36 projected onto the road pavement layer 10, the operator of the compacting vehicle 5 sees whether he moves his compacting vehicle 5 at a predefined distance behind the paving screed 9 of the road finishing machine 4. The first and the second laser line 35, 36 delimit a compacting window 37 on the road pavement layer 10 within which the compacting vehicle 5 should preferably move in order to compact the road pavement layer 10 in an optimal way.

Figure 5:
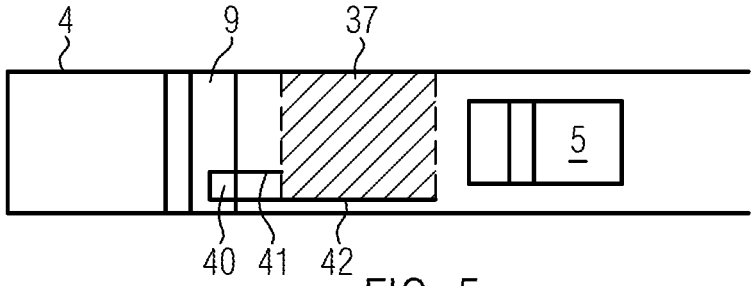
FIG. 5 is a schematic top view of a further road finishing machine according to the disclosure and a compacting vehicle following such road finishing machine.

FIG. 5 shows a further embodiment of the road finishing machine 4 according to the disclosure. The road finishing machine 4 from FIG. 5 comprises an uncoiling unit 40 that is fixed laterally on the paving screed 9. The uncoiling unit 40 drags a first and a second coiling element 41, 42 on the road pavement layer 10 behind the paving screed 9. The length of the respective coiling elements 41, 42 can be varied by means of the coiling unit 40.

The end of the first coiling element 41 tells the operator of the compacting vehicle 5 how close he may move towards the paving screed 9 as a maximum. Similarly, the end of the second coiling element 42 tells the operator of the compacting vehicle 5 the maximum distance he should maintain from the paving screed 9. The compacting window 37 is displayed between the respective ends of the first and the second coiling element 41, 42. Depending on the uncoiling length of the coiling elements 41, 42, the size of the compacting window 37 within which the compacting vehicle 5 should drive in order to obtain a desired degree of compaction for the road pavement layer 10 varies.

In all embodiments of the disclosure, the information indication unit 26 is, regardless of its design, fixed directly on the road finishing machine 4 and configured to display visual compacting messages to the operator of the following compacting vehicle 5 based on which the operator of the compacting vehicle 5 knows at what distance he should drive the compacting vehicle 5 to the road finishing machine 4 that is driving ahead in order to obtain an optimal compacting result.

As one skilled in the art would understand, the above described units, modules, machines and vehicles (e.g., unit 25, information indication unit 26, display unit 28, projection unit 34, uncoiling unit 40, measurement unit 38, control module, thermography module 19, operating module 24, etc.) may each include suitable hardware and/or software, such as one or more processors (e.g., one or more microprocessors, microcontrollers and/or programmable digital signal processors) in communication with, or configured to communicate with, one or more storage devices or media including computer readable program instructions that are executable by the one or more processors so that the control unit, module, machine, or vehicle may perform particular algorithms represented by the functions and/or operations described herein. Each unit, module, machine and vehicle may also, or instead, include one or more application specific integrated circuits, programmable gate arrays or programmable array logic, programmable logic devices, or digital signal processors.

While exemplary embodiments are described above, it is not intended that these embodiments describe all possible forms according to the disclosure. The words used in the specification are words of description rather than limitation, and it is understood that various changes may be made without departing from the spirit and scope of the disclosure. Additionally, the features of various implementing embodiments may be combined to form further embodiments according to the disclosure.

What is claimed is:

1. A road finishing machine comprising:

a paving screed to install a new road pavement layer of a paving material;

a unit for generating a dynamic compacting specification field based on thermographic geosignals with regard to at least one temperature image that exists behind the paving screed of the road finishing machine for at least one surface section of the newly installed road pavement layer;

an information indication unit provided on a portion of the road finishing machine, the information indication unit including a signal lamp to display a visual signal as a visual compacting message at least partially on the basis of the compacting specification field to an operator of a compacting vehicle that follows behind the road finishing machine to compact the newly installed road pavement layer; and a measurement unit including at least one distance sensor for measuring a distance to the following compacting vehicle, wherein the measurement unit is configured to record the distance to the following compacting vehicle;

wherein a value specification comprising a maximum and/or a minimum compacting temperature is deposited in the unit for generating the compacting specification field, the unit for generating the compaction specification field is configured to determine a minimum distance and/or a maximum distance, based on a comparison of the value specification with the thermographic geosignals for the compacting specification field, that the compacting vehicle should maintain behind the road finishing machine, the information indication unit is configured to display the minimum distance and/or the maximum distance as an additional visual compacting message in a meter and/or foot format, the unit for generating the dynamic compacting specification field is further configured to compare the measured distance to the following compacting vehicle with the minimum and/or maximum distance determined by the unit for generating the compacting specification field, and the information indication unit is configured to display the visual compacting message with the signal lamp based on the comparison of the measured distance with the minimum and/or maximum distance determined by the unit for generating the compacting specification field.

2. The road finishing machine according to claim 1 wherein the measurement unit is configured to record the distance to the following compacting vehicle.

3. The road finishing machine according to claim 1 wherein the unit for generating the dynamic compacting specification field is configured to generate the dynamic compacting specification field such that the compacting specification field is divided into several temperature zones for different temperature images behind the paving screed.

4. The road finishing machine according to claim 1 wherein the information indication unit is fixed on a roof structure of the road finishing machine.

5. The road finishing machine according to claim 1 wherein the road finishing machine comprises a thermography module for generating the thermographic geosignals with regard to the at least one temperature image that exists behind the paving screed of the road finishing machine.

6. The road finishing machine according to claim 5 wherein the unit for generating the dynamic compacting specification field is disposed within a housing of the thermography module.

7. The road finishing machine according to claim 1 wherein the unit for generating the dynamic compacting specification field is configured to generate the dynamic compacting specification field such that the compacting specification field includes information that assigns to at least one point within the compacting specification field a favorable compacting time at which the at least one point has an optimal compacting temperature.

8. A method for installing a road pavement layer by means of a road finishing machine, the method comprising:

storing a value specification comprising a maximum and/or a minimum compacting temperature in a compaction specification field generation unit, wherein the compaction specification field generation unit is configured to generate a compacting specification field based on thermographic geosignals with regard to at least one temperature image that exists behind a paving screed of the road finishing machine for at least one surface section of the road pavement layer installed by the road finishing machine;

measuring, using at least one distance sensor, a distance to a compacting vehicle that follows behind the road finishing machine to compact the road pavement layer installed by the road finishing machine;

determining, by the compaction specification field generation unit, a minimum distance and/or a maximum distance, based on a comparison of the value specification with the thermographic geosignals for the compacting specification field, that the compacting vehicle should maintain behind the road finishing machine;

comparing, by the compaction specification field generation unit, the measured distance to the compacting vehicle with the minimum and/or maximum distance determined by the compaction specification field generation unit;

displaying, with a signal lamp of an information indication unit provided on the road finishing machine, a visual compacting message to an operator of the compacting vehicle based on the comparison of the measured distance with the minimum and/or maximum distance determined by the unit for generating the compacting specification field; and displaying the minimum distance and/or the maximum distance on the information indication unit as an additional visual compacting message to the operator of the compacting vehicle, wherein the additional visual compacting message is displayed in a meter and/or foot format.

9. A road finishing machine comprising:

a paving screed to install a new road pavement layer of a paving material;

a unit for generating a dynamic compacting specification field based on thermographic geosignals with regard to at least one temperature image that exists behind the paving screed of the road finishing machine for at least one surface section of the newly installed road pavement layer;

an information indication unit provided on a portion of the road finishing machine to display at least one visual compacting message at least partially on the basis of the compacting specification field to an operator of a compacting vehicle that follows behind the road finishing machine to compact the newly installed road pavement layer; and a measurement unit including at least one distance sensor to measure a distance to the following compacting vehicle;

wherein a value specification comprising a maximum and/or a minimum compacting temperature is stored in the unit for generating the compacting specification field, the unit for generating the compaction specification field is configured to determine a minimum distance and/or a maximum distance, based on a comparison of the value specification with the thermographic geosignals for the compacting specification field, that the compacting vehicle should maintain behind the road finishing machine, the unit for generating the dynamic compacting specification field is further configured to compare the measured distance to the following compacting vehicle with the minimum and/or maximum distance determined by the unit for generating the compacting specification field, and the information indication unit includes a signal lamp to display a visual compacting message of the at least one visual compacting message based on the comparison of the measured distance with the minimum and/or maximum distance determined by the unit for generating the compacting specification field.

* * * * *